United States Patent [19]

Prewitt

[11] 4,329,691

[45] May 11, 1982

[54] AM-FM BROADBAND VEHICLE WINDSHIELD MOUNTED RADIO ANTENNA

[75] Inventor: Thomas A. Prewitt, Kokomo, Ind.

[73] Assignee: General Motors Corporation, Detroit, Mich.

[21] Appl. No.: 192,463

[22] Filed: Sep. 30, 1980

[51] Int. Cl.[3] ..... H01Q 1/32

[52] U.S. Cl. ..... 343/713

[58] Field of Search ..... 343/711, 712, 713

[56] References Cited

U.S. PATENT DOCUMENTS

| | | | |
|---|---|---|---|
| 3,728,732 | 3/1973 | Igarashi | 343/713 |
| 3,793,590 | 2/1974 | Etling et al. | 343/713 |
| 4,072,954 | 2/1978 | Comastri et al. | 343/713 |

*Primary Examiner*—Eli Lieberman

*Attorney, Agent, or Firm*—Robert M. Sigler

[57] ABSTRACT

An AM-FM broadband radio antenna for a vehicle windshield includes first and second conductors supported by the window within its aperture in reversely symmetrical relation, each of the conductors having a force first portion extending longitudinally across the substantial center of the window from a common terminal at the bottom center thereof and a second portion extending transversely away from the first portion and spaced from the top of the aperture by more than 10 centimeters to reduce slot coupling between said conductors and the windshield aperture and thus the impedance reflected to the common terminal. Third and fourth conductors, each tuned to a quarter wavelength of the FM frequency band and preferably stagger tuned, extend from the common terminal longitudinally parallel to the first portions of the first and second conductors and further reduce the impedance in FM reception at the common terminal. In a windshield having a tinted band across the top thereof of greater than 10 centimeters depth, the second portions of the first and second conductors are located just within the bottom of the tinted band.

2 Claims, 3 Drawing Figures

AM-FM BROADBAND VEHICLE WINDSHIELD MOUNTED RADIO ANTENNA

BACKGROUND OF THE INVENTION

This invention relates to AM-FM broadband radio antennas and particularly to such antennas adapted for mounting in a motor vehicle windshield. Such antennas have become relatively popular on motor vehicles because of their inconspicuous nature and because they are not as vulnerable to vandalism as are whip antennas.

Although such antennas have been generally adequate for receiving AM broadcast signals, their performance with FM broadcast signals, and particularly with FM stereo signals, has been somewhat less satisfactory. With the growing popularity of FM stereo broadcast and the increasing number of vehicles equipped with radios capable of receiving FM stereo signals, a demand is growing for a windshield mounted broadband radio antenna offering improved FM performance.

On the other hand, one of the main advantages of the windshield mounted antenna as presently designed is its generally inconspicuous nature. FIG. 1 shows the general configuration of such antennas in present vehicle production; and it should be plain from FIG. 1 that the antenna elements have been placed in such a manner that they are not generally within the field of view of a vehicle driver or passenger and are thus not generally noticed. An antenna showing improved FM reception capability should still not be annoying or objectionable in appearance to a vehicle driver or passenger.

SUMMARY OF THE INVENTION

Therefore, it is an object of this invention to provide a vehicle windshield mounted broadband AM-FM radio antenna with improved FM performance.

It is a further object of this invention to provide such an antenna which is not objectionable in appearance or bothersome to the vehicle driver or passengers.

This invention is partially based upon a discovery concerning the distance of the substantially horizontal elements of the standard vehicle windshield radio antenna from the metallic window opening of the vehicle body. It has long been known that this distance affects the AM performance of the antenna through its effect on the capacitance between the antenna elements and vehicle body. Therefore, it has been known that it is desirable to space these horizontal elements some small distance away from the body to give this capacitance an acceptable value. However, in most cases, the spacing has been on the order of 1 to 2 centimeters in those vehicles actually produced and not more than 10 centimeters in any of the prior art of which the inventor is aware.

However, the inventor has discovered that the standard windshield antenna configuration excites the metallic windshield opening of the vehicle body as a slot antenna and thus generates an undesirably large mutual impedance between the windshield aperture and antenna in FM operation which reflects back into the antenna. This coupling, and the resulting reflected impedance, can be reduced by moving the horizontal elements of the antenna farther away from the windshield aperture to a distance greater than 10 centimeters and preferably 12 to 13 centimeters. This is far beyond the distance considered necessary in the prior art on the basis of capacitance for AM reception. However, it is believed that, on most vehicle windshields, the lower horizontal elements will still not be especially noticeable to the vehicle driver or passenger, particularly on those vehicles equipped with tinted windshields where a darker tinted band is generally provided across the top of the windshield. If such a band is provided and it is greater than 10 centimeters in depth, the horizontal elements of the antenna may be placed within the band near the bottom thereof; and they will be even less noticeable.

In addition to the above, the antenna of this invention contemplates the addition of two additional vertical or longitudinal elements tuned to substantial quarter wavelength in the standard FM band. These are placed just outside the already existing vertical elements of the antenna and parallel thereto; but they join the antenna common terminal at the common terminal only. These elements further reduce the impedance at the common terminal to improve FM performance. They are preferably of slightly different lengths so as to stagger tune the FM broadcast band. It is believed that these vertical elements will also not be especially noticeable to a vehicle driver or right front seat passenger. They would, of course, be noticeable to a passenger in the center of the vehicle seat; but a substantial and growing number of vehicles are being designed and built with no provision for such a third front seat passenger; and at least these vehicles would be prime candidates for this antenna.

Further details and advantages of this invention will be apparent from the accompanying drawings and following description of a preferred embodiment.

DESCRIPTION OF THE PREFERRED EMBODIMENT

Figure 1:
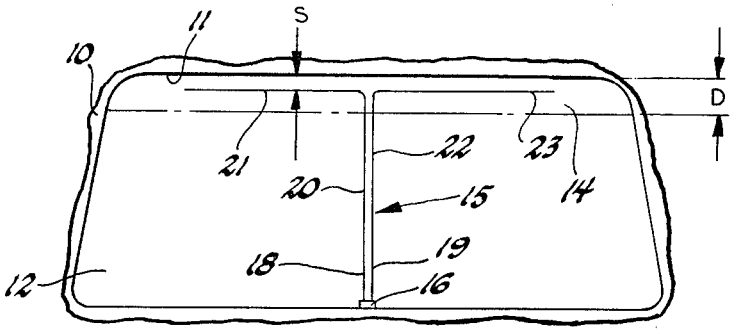
Fig. 1 PRIOR ART
FIG. 1 shows a vehicle windshield aperture and windshield with a broadband AM-FM radio antenna according to the prior art.

Referring to FIG. 1, a metallic vehicle body element 10 is provided with a windshield aperture 11 which has mounted therein a window 12. Window 12 is a standard laminated automobile windshield and may be provided with a transversely extending tinted band 14 across the top thereof having a depth D in the longitudinal direction of greater than 10 centimeters.

An AM-FM broadband radio antenna, generally indicated at 15, is supported by window 12 in the standard manner. Antenna 15 comprises a plurality of fine wires connected to a common terminal 16 and supported by the window in a predetermined configuration by, for example, being placed in the thermoplastic layer between the glass laminates of the windshield. The mounting of the antenna on or in the windshield is standard and well known and will not be further described in the specification.

Antenna 15 comprises two conductors 18 and 19 arranged in reversely symmetrical relation within the windshield aperture 11. Conductor 18 has a vertical or longitudinal element 20 connected at the bottom to the common terminal at the bottom center of the windshield aperture 11 and extending vertically to a point near the top center thereof. Attached to this end and extending horizontally to the side of the windshield aperture is a horizontal or transverse element 21. Element 21 is substantially parallel to the top of the windshield aperture 11 and is spaced a longitudinal distance S therefrom, where S is generally 1 to 3 centimeters. Conductor 19 comprises similarly configured vertical or longitudinal element 22 and a horizontal or transverse member 23. Members 20 and 22 are substantially parallel to each other and spaced by slightly more than 1 centimeter.

Figure 2:
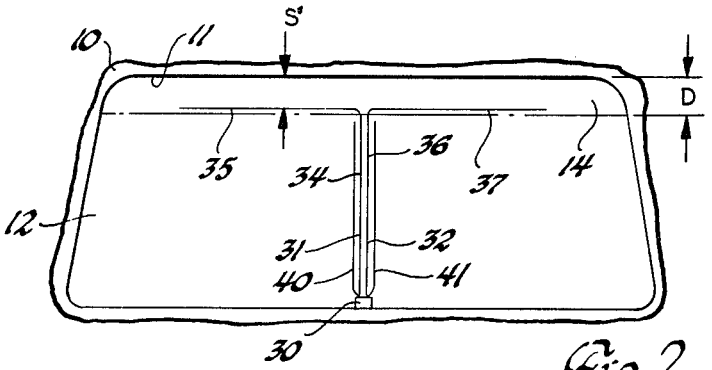
FIG. 2 shows a vehicle windshield aperture and window with a broadband AM-FM radio antenna according to this invention.

Referring to FIG. 2, an identical metallic vehicle body element 10 with a windshield aperture 11 and window 12 are shown. Window 12 is further provided with an identical band 14 of greater than 10 centimeters depth. A common terminal 30 is located at the bottom center of aperture 11 and from it extend a pair of conductors 31 and 32 supported by the window within aperture 11 in reversely symmetrical relation. Conductor 31 comprises a vertical or longitudinal element 34 and a horizontal or transverse element 35 which are similar to elements 20 and 21 of FIG. 1 except that element 35 is located just within the bottom of the tinted band 14 at a longitudinal spacing S′ of greater than 10 centimeters and preferably 12 to 13 centimeters from the window aperture 11. Conductor 32 similarly comprises vertical or longitudinal element 36 and horizontal or transverse element 37 in similar arrangement. As discussed in the Summary of the Invention, the larger spacing S′ of the horizontal or transverse elements 35 and 37 from windshield aperture 11 reduces the slot coupling between the antenna and the windshield aperture 11 to thereby reduce the impedance reflected into the common terminal 30 during FM reception.

In addition, third and fourth conductors 40 and 41 also extend vertically or longitudinally upward from common terminal 30 parallel to members 34 and 36. In FIG. 2, conductor 40 is shown as being outside member 34 and conductor 41 is shown as being outside member 36. Conductor 40 may be, for example, 20.75 inches or 52.7 cm in length while conductor 41 is 21.75 inches or 55.2 cm in length so that the two conductors are tuned to different quarter wavelengths within the FM band to stagger tune that band and thus present a broader tuning. These elements further reduce the impedance at common terminal 30 in FM reception, ideally to a value between 50 to 200 ohms with less than 45° phase shift.

Figure 3:
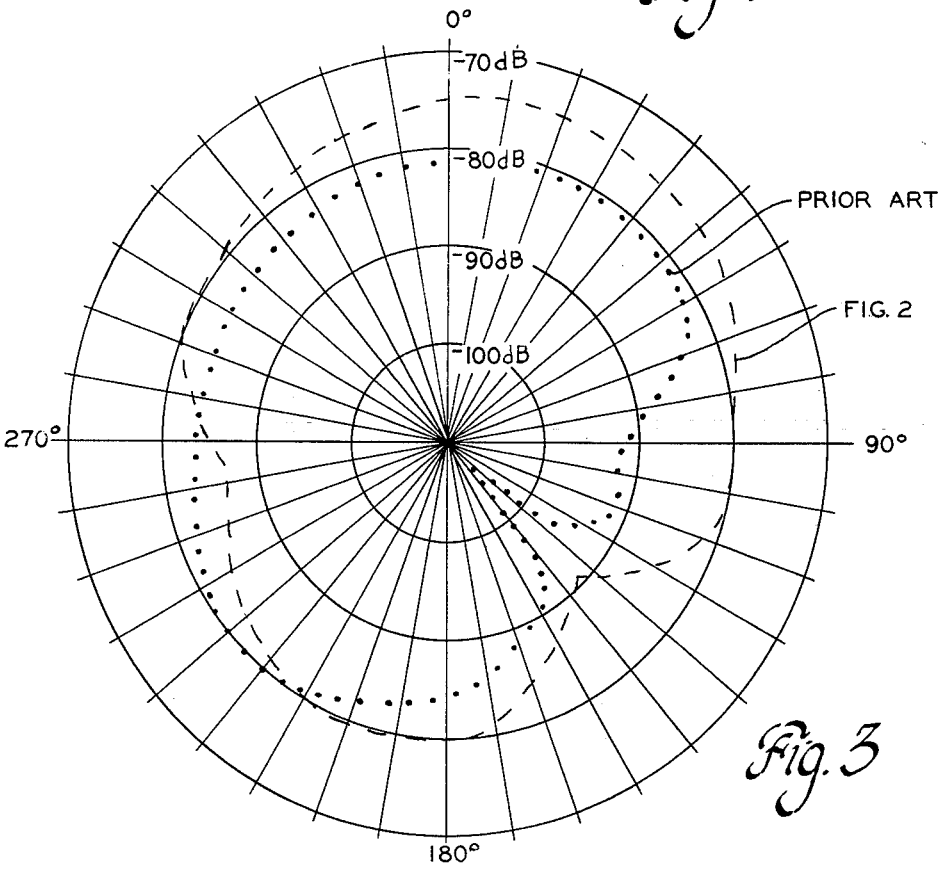
FIG. 3 shows a graphical representation of comparative FM antenna performance at 89 megahertz for one particular vehicle equipped with the antennas of FIGS. 1 and 2.

Referring to FIG. 3, the polar FM response of the antennas of FIG. 1 and FIG. 2 are shown in a sample vehicle at a frequency of 89 megahertz in a 360° circle around the vehicle. Over most of the range around the vehicle, the antenna of FIG. 2 shows at least a five decibel improvement over the prior art antenna of FIG. 1. In the one segment of approximately 70° where the prior art antenna gives better performance, the antenna of FIG. 2 still provides an acceptable level of performance. In addition, the extreme drop in performance at substantially 135° of the prior art antenna is avoided in the antenna of this invention, so that the ratio of best to worst reception is smaller, thus providing a more consistent polar response.

Although the antenna is shown with the transverse elements near the top of the windshield, it is considered within the scope of this invention in its broadest sense to longitudinally reverse the antenna with the common terminal at the top and the transverse elements at the bottom.

The embodiments of the invention in which an exclusive property or privilege is claimed are defined as follows:

1. An AM-FM broadband radio antenna for a vehicle mounted radio providing reduced FM antenna impedance and comprising:

a metallic body element defining a substantially rectangular aperture;

a window in the aperture;

a common terminal supported on the window at the transverse center thereof;

first and second conductors supported by the window in the aperture in reversely symmetrical relation, each of the conductors having a first portion extending longitudinally across the substantial center of the window from the common terminal and a second portion extending transversely away from the first portion, the second portions being spaced from the metallic body element by more than ten centimeters, whereby slot coupling between the first and second conductors and the metallic body element, and thus impedance reflected into the antenna, is reduced; and third and fourth conductors supported by the window in the aperture, said conductors extending from the common terminal adjacent and parallel to the first portions of the first and second conductors, said third and fourth conductors having lengths tuned to one quarter wavelengths within the FM broadcast band, whereby the impedance of the antenna in FM operation is further reduced, the impedance reductions providing improved FM performance.

2. An AM-FM broadband radio antenna for a vehicle mounted radio, the vehicle including a metallic body element defining a substantially rectangular aperture and having a window in the aperture having a transversely extending tinted portion at the top thereof of greater than 10 centimeters depth, the antenna comprising:

a common terminal supported on the window at the transverse center thereof;

a first and second conductor supported by the window in the aperture in reversely symmetrical relation, each of the conductors having a first portion extending longitudinally across the transverse center of the window from the common terminal and a second portion extending transversely away from the first portion, the second portions being located just within the bottom of the tinted band and thus spaced from the metallic body element by more than 10 centimeters, whereby slot coupling between the first and second conductors and the metallic body element, and thus impedance reflected into the antenna, is reduced; and third and fourth conductors supported by the window in the aperture, said conductors extending from the common terminal adjacent and parallel to the first portions of the first and second conductors, said third and fourth conductors having lengths tuned to one quarter wavelengths within the FM broadcast band, whereby the impedance of the antenna and FM operation is further reduced, the impedance reductions providing improved FM performance.

* * * * *